US005798322A

United States Patent [19]

Brannen et al.

[11] Patent Number: 5,798,322

[45] Date of Patent: Aug. 25, 1998

[54] FRICTION-MODIFYING ADDITIVES FOR SLIDEWAY LUBRICANTS

[75] Inventors: William Brannen, Westlake, Ohio; Aaron Myers, Spartanburg, S.C.; Harish Patel, Spartanburg, S.C.; Philip R. Miller, Spartanburg, S.C.

[73] Assignee: Gateway Additive Company, Spartanburg, S.C.

[21] Appl. No.: 705,614

[22] Filed: Aug. 30, 1996

[51] Int. Cl.[6] ..... C10M 141/02; C10M 141/06; C10M 141/10

[52] U.S. Cl. ..... 508/442; 508/434; 508/437; 508/440; 508/493

[58] Field of Search ..... 508/433, 436, 508/485, 442, 437, 434, 440, 493

[56] References Cited

U.S. PATENT DOCUMENTS

| | | | |
|---|---|---|---|
| 4,061,581 | 12/1977 | Leleu et al. | 508/287 |
| 4,116,877 | 9/1978 | Outten et al. | 508/442 |
| 4,130,494 | 12/1978 | Shaub et al. | 508/408 |
| 4,601,840 | 7/1986 | Zehler et al. | 508/485 |
| 4,968,452 | 11/1990 | Seiki | 508/488 |
| 5,151,205 | 9/1992 | Culpon, Jr. | 508/488 |
| 5,360,565 | 11/1994 | Junga | 508/273 |

OTHER PUBLICATIONS

Elco 313 slideway lubricant additive product brochure—The Elco Company, Cleveland, Ohio—Jan., 1993.

Gateway Additive Co. product brochure entitled "Stability of SYN–ESTER and ADDCO Esters"—Sep., 1992.

Gateway Additive Co. product brochure entitled "SYN–ESTER GY Series"—Oct., 1992.

Gateway Additive Co. product brochure entitled "SYN–ESTER® GY–35 and GY–500"—Apr., 1995.

Gateway Additive Co. product brochure entitled "ADDCO 360–P"—Oct., 1992.

*Primary Examiner*—Margaret Medley

*Attorney, Agent, or Firm*—William A. Simons; Wiggin & Dana

[57] ABSTRACT

A friction-modifying additive composition for a slideway lubricant comprising a mixture of at least one polymeric ester of certain dibasic and monobasic acids with selected organo phosphorus compounds.

15 Claims, No Drawings

FRICTION-MODIFYING ADDITIVES FOR SLIDEWAY LUBRICANTS

BACKGROUND OF THE INVENTION

1. Field of The Invention

This invention relates to a friction-modifying additive composition for a slideway lubricant. In particular, the present invention relates to a friction-modifying additive composition for slideway lubricants that comprises a combination of selected polymeric esters of dibasic and monobasic acids with selected organo phosphorous compounds.

2. Brief Description of Art

A slideway is a mechanical guide designed to provide a machine tool with a track surface that is stable under load (i.e., minimal deflection) with a consistent finish for constant frictional forces, regardless of the rate of movement. Machine builders have met these design goals by constructing slideways in various configurations (horizontal, vertical, angled) and fabricating them from several different materials (iron, steel or plastic).

As machine tools have become more complex, it is imperative that their lubricants be formulated to maximize the performance of the slideways. And, in addition, it has become increasingly important to extend the useful lifetime of the coolants and metal-working fluids which are continuously in contact with the slideway lubricant. Slideway lubricants have generally contained friction-modifying additive compositions in amounts from 1% to 10% by weight of the lubricant base stock. These additive compositions must possess certain combination of properties: (1) excellent resistance to stick-slip (i.e., the uneven motion of one part of a machine tool in relation to its mating part); (2) good solubility in most base stocks; (3) provide the base stock with thermal stability at prolonged elevated temperatures; (4) provide friction-modifying, anti-wear and extreme pressure (E.P.) performance to the slideway base stock; (5) provide good demulsibility characteristics; and (6) compatibility with coolants and metal-working fluids.

One new friction-modifying additive package for slideway lubricants is ELCO 313 made by the Elco Corporation of Cleveland, Ohio. While this product has certain improved performance characteristics, it still has properties that contribute to reducing the useful life of coolants and metal-working fluids. Specifically, it contains sulfur compounds that contribute to bacterial growth and odor formation in coolants and metal-working fluids.

Thus, there is still a need for better friction-modifying additive compositions for slideway lubricants.

BRIEF SUMMARY OF THE INVENTION

Accordingly, one aspect of the present invention is directed to a friction-modifying additive composition for a slideway lubricant formulation comprising:

(a) at least one polymeric ester of a dibasic acid and a monobasic acid, said acids containing 5 to 22 carbon atoms and wherein the ester is an aliphatic group and said polymer having a weight average molecular weight ($M_w$) from about 50,000 to 3,000,000 and an acid number from about 0.25 to about 30;

(b) at least one organic phosphorous compound selected from the group consisting of dialkyl hydrogen phosphates, trialkyl phosphites, aryl organo phosphites, alkyl-aryl phosphates, and alkyl amine salt of organo phosphoric acid; and (c) a sufficient amount of a petroleum oil to contain (a) and (b) said oil having a viscosity from ISO-22 to ISO-680;

wherein the weight ratio of said polymeric esters to said organo phosphorus compound is from about 2:1 to about 12:1.

A second aspect of the present invention is directed to a slideway lubricant containing said additive composition in an amount from 0.75% to about 4% by weight of the total slideway lubricant.

DETAILED DESCRIPTION OF THE PREFERRED EMBODIMENTS OF THE INVENTION

The present invention provides a friction-modifying additive composition that provides many types of slideway lubricants with superior friction-modifying and demulsifying properties. As noted above, this additive composition has three critical components. The first component is at least one polymeric ester of dibasic and monobasic acids. Suitable polymeric esters of dibasic and monobasic acids are formed by polymerization of dibasic and monobasic acids, each acid containing from about 5 to 22 carbon atoms (preferably 6 to 18 carbon atoms) where the ester group is an aliphatic group, and the resultant polymer has both monobasic acid ester repeating units and dibasic acid ester repeating units and has a weight average molecular weight ($M_w$) of between 50,000 and 3,000,000 and an acid number from 0.25 to 30. One particularly preferred polymeric ester is SYN-ESTER GY-25 from Gateway Additive Company, which is a high molecular weight polymerized ester with a $M_w$ of about 150,000 and an acid number of about 16 to 24 and is a pentaerythritol initiated polymer of a mixture of monobasic acids (i.e., stearic acid and coconut fatty acids) and a dibasic acid (i.e., adipic acid).

More preferably, the polymeric ester has a weight average molecular weight from about 1,500,000 to about 2,500,000 and an acid number from about 0.5 to about 3. A more preferred polymeric ester is SYN-ESTER GY-500 from Gateway Additive Company. It is a very high molecular weight ($M_w$=2,100,000), low acid number (Acid Number= 0.5–3) polymerized ester that is a pentaerythritol initiated polymer of a mixture of a monobasic acid (i.e., coconut fatty acids) and a dibasic acid (i.e., adipic acid).

Acid Number as used herein is defined as the amount of potassium hydroxide required to neutralize the free acid present in the sample. The reported values are in mgKOH/gram units.

The second component of the additive composition is selected organo phosphorus compounds. One preferred dialkyl hydrogen phosphite is diisooctyl hydrogen phosphite. One preferred trialkyl phosphite is tris(tridecyl) phosphite. One preferred aryl organo phosphite is triphenyl phosphite. One preferred alkyl-aryl phosphate is ethoxylated nonylphenol phosphate. One preferred organo phosphate is tridecyl phosphate. One preferred alkyl amine salt of organo phosphoric acid is tridecyl phosphate, alkyl amine salt.

The alkyl amine salt of organo phosphoric acid is the preferred species of selected organo phosphorus compounds used in this invention. ADDCO 360-P [a mixture of tridecyl phosphate(CAS#52933-07-0) and branched 3-(tridecyloxy)-1-propanamine (CAS#68511-40-0) produced by Gateway Additive Company is the most preferred organo phosphorous compound.

Preferably, the weight ratio of polymeric ester to the organo phosphorus compound is from about 4:1 to about 8:1.

The third component of the friction-modifying additive composition is a petroleum oil. Any suitable naphthenic or paraffinic petroleum oil that is compatible with the first and second components of this composition, as well as the base stock of the slideway lubricant can be used. The main function of the petroleum oil is a coupling agent whereby the components (a) and (b) can be held together in a solution and as viscosity reducer to enable easier commercial handling of the additive composition. The preferred petroleum oils include paraffinic ISO-22 to ISO-220 viscosity grades. The "ISO" as used herein refers to ISO (International Standards Organization) Number that is the oil viscosity in centistokes at 37.8° C. Preferably, the amount of petroleum oil is from 10% to 80% by weight, more preferably, from 15% to about 45% by weight, of the additive composition. However, any sufficient amount that contains the other two components in solution may be used. If desired, the oil may be the same oil used as the base stock for the slideway lubricant.

The three components may be blended together by any suitable means. One preferred method is merely placing the components in an agitated vessel at 50°–70° C. until they are thoroughly mixed.

After this blending step, the resulting friction-modifying additive is added to a petroleum base stock in preferred amounts from about 1.0% to about 3.0% by weight of the total slideway lubricant (i.e., base stock plus additives). Any suitable lubricant base stock may be used.

It is also preferable to add a small amount of tackifier to the base stock along with the friction-modifying additive composition of the present invention. Oil-solubilized polyisobutylene is one suitable tackifier. Generally, if a tackifier is employed, it is present in amounts from about 0.25% to about 4% by weight of the total slideway lubricant.

The combination of these polymeric ester compounds with organo phosphorus compounds of the present invention provides improved demulsibility and friction-modifying characteristics, as well as has improved compatibility with coolants and metal-working fluid that may come into contact with it (i.e., because it has no sulfur compounds) and will not contribute to bacterial growth and odor formation to the degree that sulfur-containing slideway additive packages have in the past. Furthermore, because of the good inherent demulsification properties of the friction-modifying additive composition of the present invention, no further demulsifiers need be added to the slideway lubricant. Still further, the present additive composition is substantially odorless and light-colored, whereas the prior art sulfur-containing additive packages have a strong odor and are dark colored. Thus, the people working in this field would prefer the present additive composition.

The following Examples further illustrate the preset invention. All parts and percentages are by weight and all temperatures are degrees Celsius unless explicitly stated otherwise.

EXAMPLE 1

Friction Tests

Seven blends of a polymerized ester, one or two phosphorus compounds and a lubricant (ISO-68 petroleum oil) were prepared.

These lubricant compositions were named Blends A through G and each contained the following components:

Blend A 0.6% SYN-ESTER GY-25[1]/

0.1% ADDCO 360-P[2]/

1.0% polybutylene tackifier[3]/

Balance ISO-68[4]/

[1]SYN-ESTER GY-25 pentaerythritol initiated polymer is a pentaerythritol initiated polymer of a mixture of monobasic acids (i.e., stearic acid and coconut fatty acids) and a dibasic acid (i.e., adipic acid) having $M_w$ of about 150,000 and Acid No. of 16 to 24 and available from Gateway Additive Company of Spartanburg, S.C.

[2]ADDCO 360-P alkyl amine salt of organo phosphoric acid (a mixture of tridecyl phosphate (CAS#52933-07-0) and branched 3-(tridecyloxy)-1-propanamine (CAS#68511-40-0) and available from Gateway Additive Company of Spartanburg, S.C.

[3]Polyisobutylene having a $M_w$ of about 1,000,000 dissolved in petroleum oil.

[4]ISO-68 petroleum oil available from Shell Oil Co.

Blend B 1.0% SYN-ESTER GY-25[1]/

0.5% ADDCO 360-P[2]/

1.0% Polyisobutylene tackifier[3]/

Balance ISO-68[4]/

Blend C 1.0% SYN-ESTER GY-500[5]/

0.5% ADDCO 360-P[2]/

1.0% Polyisobutylene tackifier[3]/

Balance ISO-68[4]/

Blend D 0.9% SYN-ESTER GY-25[1]/

0.15% Elco 301[6]/

1.0% Polyisobutylene[3]/

Balance ISO-68[4]/

[5]GY-500 pentaerythritol initiated polymer of a mixture of a monobasic acid (i.e., coconut fatty acids) and a dibasic acid (i.e., adipic acid) having a $M_w$ of about 2,100,000 and an Acid No. of 0.5 to 3) available from Gateway Additive Co. of Spartanburg, S.C.

[6]ELCO-301 organo phosphate amine salt available from the Elco Corporation of Cleveland, Ohio.

Blend E 0.9% SYN-ESTER GY-25[1]/

0.15% Ciba Geigy TPPT[7]/

0.15% ADDCO 360-P[2]/

1.0% Polybutylene tackifier[3]/

Balance ISO-68[4]/

Blend F 0.9% SYN-ESTER GY-25[1]/

0.15% ADDCO 360-P2/

1.0% Polybutylene tackifier[3]/

Balance ISO-68[4]/

Blend G 0.9% SYN-ESTER GY-500[5]/

0.15% ADDCO 360-P[2]/

1.0% Polybutylene tackifier[3]/

Balance ISO-68[4]/

Each of these blends was subjected to a Cincinnati Milacron Stick/Slip test. The results of these tests are as follows:

[7]Ciba Geigy TPPT triphenylphosphorothionate available from Ciba Geigy, Inc. of Tarrytown, N.Y.

| Blend | CMM |
|---|---|
| A | 0.73 |
| B | 0.77 |
| C | 0.77 |
| D | 0.79 |
| E | 0.80 |
| F | 0.76 |
| G | 0.73 |

These results report a ratio of static to kinetic friction (steel on steel). A reported ratio of 0.80 or less is suitable for slideway lubricants.

Blend G was also subjected to a friction test using cast iron on cast iron and cast iron on plastic-simulated slideways. It passed that test.

EXAMPLE 8

Soluble Oil Demulsibility Test

Blend G was subjected to a soluble oil demulsibility test. The test consists of shaking 80 ml. of water diluted soluble oil (95% water and 5% oil) with 20 ml. of the slideway lubricant. The mixture is then observed over a time period of seven days and results reported at one hour, one day and seven days. Blend G passed this test.

EXAMPLES 9–11

Deionized Water Demulsibility Tests

Blends A, F and G were subjected to a deionized water test. In this test, 200 ml. of a finished slideway oil (blends A, F or G) was sheared in a waring blender for 30 seconds with 50 ml. of deionized water and then transferred to a 250 ml. graduated cylinder. The ml. of water separated is recorded after one hour and 24 hours. To pass the test, substantially all of the 50 ml. of water must be separated after 24 hours. Blends A, F and G all passed this test.

EXAMPLES 12 and 13

ASTM D-1401 Demulsibility Test

Blend F and G were subjected to ASTM D-1401 demulsibility test. Blend G passed, but blend F did not. The reason Blend F did not pass this test is not clearly known. It is suspected that the high acid number of GY-25 relative to GY-500 was the reason for failing.

EXAMPLES 14–17

4-Ball Wear Tests

Blends A, D, F and G were all subjected to 4-ball wear test (ASTM D-4172). The results of this test (in mm wear at 20 Kg., 1 hr. 1800 rpm, 130° F.) are as follows:

| Blend | mm. Wear |
|---|---|
| A | 0.39 |
| D | 0.27 |
| F | 0.29 |
| G | 0.30 |

These results indicate good friction modification and anti-wear properties for all four blends, thereby making them suitable for slideway lubricants.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims.

What is claimed is:

1. A slideway lubricant additive composition consisting essentially of:

(a) at least one polymeric ester of a mixture of dibasic and monobasic acids wherein each acid contains 5 to 22 carbon atoms and wherein the ester group is an aliphatic group and wherein the resultant polymer has a weight average molecular weight ($M_w$) from about 50,000 to 3,000,000 and having an Acid Number of about 0.5 to about 30;

(b) at least one organo phosphorous compound selected from the group consisting of dialkyl hydrogen phosphites, trialkyl phosphites, aryl organo phosphites, alkyl-aryl phosphates, and alkyl amine salt of organo phosphoric acid; and (c) a sufficient coupling agent amount of petroleum oil to contain (a) and (b) in a solution; wherein the weight ratio of said polymeric ester to said organo phosphorus compound is from about 2:1 to about 12:1 and wherein said viscosity of said petroleum oil is ISO-22 to ISO-680.

2. The additive composition of claim 1 wherein said polymeric ester is a mixed ester of more than one monobasic acid with one dibasic acid.

3. The additive composition of claim 1 wherein each acid in (a) contains 6 to 18 carbon atoms.

4. The additive composition of claim 1 wherein polymeric ester has a $M_w$ of about 150,000 and an Acid Number of about 16 to 24 and is a pentaerythritol initiated polymer of a mixture of stearic acid, coconut fatty acids and adipic acid.

5. The additive composition of claim 1 wherein said polymeric ester has a $M_w$ from about 1,500,000 to about 2,500,000 and an Acid Number from about 0.5 to about 3.

6. The additive composition of claim 1 wherein said polymeric ester has a $M_w$ of 2,100,000, an Acid Number of 0.5 to 3 and is a pentaerythritol initiated polymer of a mixture of coconut fatty acids and adipic acid.

7. The additive composition of claim 1 wherein said organo phosphorus compound is an alkyl amine salt of an organo phosphoric acid.

8. The additive composition of claim 7 wherein said alkyl amine salt of an organo phosphoric acid is a mixture of tridecyl phosphate and branched 3-tridecyloxy-1-propanamine.

9. The additive composition of claim 1 wherein the weight ratio of polymeric ester to phosphoric compound is from 4:1 to about 8:1.

10. The additive composition of claim 1 wherein the petroleum oil has a viscosity of ISO-22 to ISO-220.

11. The additive composition of claim 1 wherein the amount of said petroleum oil in said additive composition is from about 10% to about 70% by weight of the additive composition.

12. A slideway lubricant composition comprising a lubricant base stock and about 0.75% to about 4% by weight of the additive composition of claim 1.

13. The slideway lubricant composition of claim 12 further comprising a tackifier.

14. The slideway lubricant composition of claim 13 wherein said tackifier is oil-solubilized polyisobutylene.

15. The slideway lubricant composition of claim 13 wherein said tackifier is present in an amount from 0.25% to about 4%, based on the total weight of the slideway lubricant.

* * * * *